US006765200B2

(12) United States Patent
Maekawa et al.

(10) Patent No.: US 6,765,200 B2
(45) Date of Patent: Jul. 20, 2004

(54) MASS SPECTROMETRY AND MASS SPETROMETER USING THE SAME

(75) Inventors: Akira Maekawa, Hitachinaka (JP); Akira Owada, Hitachinaka (JP); Yasushi Terui, Tsuchiura (JP)

(73) Assignee: Hitachi, Ltd., Tokyo (JP)

( * ) Notice: Subject to any disclaimer, the term of this patent is extended or adjusted under 35 U.S.C. 154(b) by 311 days.

(21) Appl. No.: 09/792,582

(22) Filed: Feb. 23, 2001

(65) Prior Publication Data

US 2001/0019107 A1 Sep. 6, 2001

(30) Foreign Application Priority Data

Feb. 25, 2000 (JP) ..... 2000-54456

(51) Int. Cl.[7] ..... H01J 49/10; H01J 49/32; H01J 39/34; H01D 59/44

(52) U.S. Cl. ..... 250/288; 250/281; 250/282; 250/287; 250/290; 250/291; 250/292; 250/339; 250/339.12; 250/286

(58) Field of Search ..... 250/281, 282, 250/284, 286, 287, 288, 290, 291, 292, 339, 339.12

(56) References Cited

U.S. PATENT DOCUMENTS 5,910,655 A * 6/1999 Skilling ..... 250/281

* cited by examiner

*Primary Examiner*—John R. Lee
*Assistant Examiner*—David A. Vanore
(74) *Attorney, Agent, or Firm*—Kenyon & Kenyon

(57) ABSTRACT

In order to provide an equipment that permits easy elimination of interference ions even in a low resolution mass spectrometer, the isotope mass number information and the isotope presence ratio information for each element are stored, and processing is done as is shown in FIG. 1 using such information and the measurement results, and the amount of target elemental ions is calculated by calculating and eliminating the amount of interference caused by other elemental isotopes to the target element. Because of this, when carrying out element analysis using a mass spectrometer with a relatively low resolution, the user can easily obtain the measurement result of the amount of any target elemental ions.

10 Claims, 11 Drawing Sheets

| MASS NUMBER | ELEMENT NAME AND PRESENCE RATIO (THE SHARE OF THE AMOUNT OF ION OF THAT ELEMENT TO THE TOTAL AMOUNT) | | | |
|---|---|---|---|---|
| ⋮ | ⋮ | ⋮ | ⋮ | ⋮ |
| 111 | 111Cd (12.8%) | | | |
| 112 | 112Cd (24.1%) | 112Sn (1.01%) | | |
| 113 | 113Cd (12.2%) | | 113In (4.3%) | |
| 114 | 114Cd (28.7%) | 114Sn (0.67%) | | |
| 115 | | 115Sn (0.38%) | 115In (95.7%) | |
| 116 | 116Cd (7.5%) | 116Sn (14.8%) | | |
| 117 | | 117Sn (7.75%) | | |
| 118 | | 118Sn (24.3%) | | |
| 119 | | 119Sn (8.6%) | | |
| 120 | 120Te (0.09%) | 120Sn (32.4%) | | |
| ⋮ | ⋮ | ⋮ | ⋮ | ⋮ |
| 130 | 130Ba (0.106%) | 130Te (34.5%) | 130Xe (4.1%) | |
| 131 | | | 131Xe (21.2%) | |
| 132 | 132Ba (0.101%) | | 132Xe (26.9%) | |
| 133 | | | | 133Cs (100%) |
| 134 | 134Ba (2.42%) | | 134Xe (10.4%) | |
| 135 | 135Ba (6.59%) | | | |
| 136 | 136Ba (7.85%) | 136Ce (0.2%) | 136Xe (8.9%) | |
| 137 | 137Ba (11.2%) | | | |
| 138 | 138Ba (71.7%) | 138Ce (0.25%) | 138La (0.09%) | |
| 139 | | | 139La (99.91%) | |
| 140 | | 140Ce (88.45%) | | |
| 141 | 141Pr (100%) | | | |
| 142 | | 142Ce (11.1%) | 142Nd (27.2%) | |
| ⋮ | ⋮ | ⋮ | ⋮ | ⋮ |

FIG. 6

50

ELEMENT NUMBER : 58 ELEMENT NAME : Ce

| | | | | | | | | | | | | | | | | | |
|---|---|---|---|---|---|---|---|---|---|---|---|---|---|---|---|---|---|
| H | | | | | | | | | | | | | | | | | He |
| Li | Be | | | | | | | | | | | B | C | N | O | F | Ne |
| Na | Mg | | | | | | | | | | | Al | Si | P | S | Cl | Ar |
| K | Ca | Sc | Ti | V | Cr | Mn | Fe | Co | Ni | Cu | Zn | Ga | Ge | As | Se | Br | Kr |
| Rb | Sr | Y | Zr | Nb | Mo | Tc | Ru | Rh | Pd | Ag | Cd | In | Sn | Sb | Te | I | Xe |
| Cs | Ba | L | Hf | Ta | W | Re | Os | Ir | Pt | Au | Hg | Tl | Pb | Bi | Po | At | Rn |
| Fr | Ra | A | | | | | | | | | | | | | | | |
| | | L | La | Ce | Pr | Nd | Pm | Sm | Eu | Gd | Tb | Dy | Ho | Er | Tm | Yb | Lu |
| | | A | Ac | Th | Pa | U | Np | Pu | Am | Cm | Bk | Cr | Es | Fm | Md | No | Lr |

FIG. 7

ISOTOPE INFORMATION

51

| RECOMMENDED | m/z | PRESENCE RATIO (%) | EQUATION FOR INTENSITY CALCULATION |
|---|---|---|---|
| | 130 | 0.106 | NONE |
| | 132 | 0.101 | NONE |
| | 134 | 2.417 | NONE |
| | 135 | 6.592 | NONE |
| | 136 | 7.854 | NONE |
| ● | 137 | 11.232 | NONE |
| ● | 138 | 71.698 | NONE |

FIG. 8

INTERFERENCE ION INFORMATION

52

| SKIP | m/z | ELEMENT ION |
|---|---|---|
| | 137 | *Ba(11.232) |
| | 138 | *Ba(71.698) *La(0.090) *Ce(0.251) |
| | 139 | *La(99.910) |
| | 140 | *Ce(88.450) |
| | 141 | *Pr(100.000) |
| | 142 | *Ce(11.114) *Nd(27.200) |
| | 143 | Nd(12.200) |

FIG. 12

61

| | | | | | | | | | | | | | | | | | |
|---|---|---|---|---|---|---|---|---|---|---|---|---|---|---|---|---|---|
| H | | | | | | | | | | | | | | | | | He |
| Li | Be | | | | | | | | | | | B | C | N | O | F | Ne |
| Na | Mg | | | | | | | | | | | Al | Si | P | S | Cl | Ar |
| K | Ca | Sc | Ti | V | Cr | Mn | Fe | Co | Ni | Cu | Zn | Ga | Ge | As | Se | Br | Kr |
| Rb | Sr | Y | Zr | Nb | Mo | Tc | Ru | Rh | Pd | Ag | Cd | In | Sn | Sb | Te | I | Xe |
| Cs | Ba | L | Hf | Ta | W | Re | Os | Ir | Pt | Au | Hg | Tl | Pb | Bi | Po | At | Rn |
| Fr | Ra | A | | | | | | | | | | | | | | | |
| | | L | La | Ce | Pr | Nd | Pm | Sm | Eu | Gd | Tb | Dy | Ho | Er | Tm | Yb | Lu |
| | | A | Ac | Th | Pa | U | Np | Pu | Am | Cm | Bk | Cr | Es | Fm | Md | No | Lr |

ELEMENT NUMBER : 138

ELEMENT NAME : Ba

FIG. 13

ISOTOPE INFORMATION

62

| MEAS-UREMENT | RECOM-MENDED | m/z | PRESENCE RATIO (%) |
|---|---|---|---|
| | | 130 | 0.106 |
| | | 132 | 0.101 |
| | | 134 | 2.417 |
| | | 135 | 6.592 |
| | | 136 | 7.854 |
| ● | ● | 137 | 11.232 |
| ● | ● | 138 | 71.698 |

FIG. 14

63

MEASUREMENT ION

| m/z | ELEMENT NAME |
|---|---|
| 137 | 137Ba |
| 138 | 138Ba |

FIG. 15

64

INTERFERENCE ION INFORMATION

| m/z | ELEMENT ION |
|---|---|
| 137 | *Ba(11.232) |
| 138 | *Ba(71.698) *La(0.090) *Ce(0.251) |
| 139 | *La(99.910) |
| 140 | *Ce(88.450) |
| 141 | *Pr(100.000) |
| 142 | *Ce(11.114) *Nd(27.200) |
| 143 | Nd(12.200) |
| 144 | *Nd(23.800) Sm(3.070) |
| 145 | Nd(8.300) |

FIG. 16

65

INTERFERENCE MOLECULE ION INFORMATION

| | | | |
|---|---|---|---|
| ☐ CHLORINE ION | ☐ NITRATE ION | ☐ SULFATE ION | ☐ ENVIRONMENT WATER |
| ☐ USER 1 | ☐ USER 2 | ☐ USER 3 | ☐ USER 4 |

FIG. 17

| 71 ELEMENT | 72 PEAK m/z | 73 INTENSITY | 74 RESOLUTION | 75 CORRECTED INTENSITY | 76 REFERENCE RATIO | 77 DENSITY (ppb) | 78 INTERFERENCE ION INTENSITY |
|---|---|---|---|---|---|---|---|
| 138Ba | 138.0 | 5000 | 0.86 | 4994.81 | 71.70 | 4.995 | 138La/1.80, 138Ce/3.39 |
| 138La | 138.0 | 5000 | 0.86 | 1.80 | 0.09 | 0.002 | 138Ce/3.39, 138Ba/4994.81 |
| 139La | 139.0 | 2000 | 0.86 | 2000.00 | 99.91 | 2.000 | |
| 138Ce | 138.0 | 5000 | 0.86 | 3.39 | 0.25 | 0.003 | 138La/1.80, 138Ba/4994.81 |
| 140Ce | 140.0 | 1200 | 0.86 | 1200.00 | 88.45 | 1.200 | |

MASS SPECTROMETRY AND MASS SPETROMETER USING THE SAME

BACKGROUND OF THE INVENTION

The present invention relates to a mass spectrometry and equipment for carrying out the same, and in particular to the technology of element isotope identification in a mass spectrometer using a plasma ion source.

Conventionally, when carrying out isotope identification of an ion using a mass spectrometer the method of carrying out analysis using a high-resolution mass spectrometer (the milli-mass method) was being used widely. In this method, the mass numbers in which the target ion is present are scanned using a high-resolution mass spectrometer, the minute mass difference (several milli-amu to several tens of milli-amu) resulting out of the mass loss effect is measured, thereby carrying out the identification of the isotope of the material present for that mass number. In this method, since it is easy to detect the amount present of each elemental ion individually, it is easily possible to judge the amount of target ions present. An example of this method is disclosed in Japanese Patent Publication No. Hei 11-260310 and other publications.

In recent years, although the resolution is low, since the equipment itself is small-sized and also simple and has the feature of being relatively inexpensive, the quadruple-electrode type mass spectrometer is started to being used very widely. Recently, even with such relatively simple and low-resolution quadruple-electrode type mass spectrometers, there is an increasing need for carrying out more detailed ion analysis.

However, in such mass spectrometers, since the resolution is low, being about several tens of milli-amu or more at different mass numbers, it is very difficult to detect very small mass differences of each element. In this context, generally, the method of isotope identification using the ratio of presence of isotopes of the element is being used as a different approach. In this method, for the target ion, the mass numbers in which the element isotopes containing that ion are scanned over a range of several to several tens of amu, and the composition of the element is analyzed by comparing with the presence ratio of the isotopes of the element. An example of this method has been disclosed in Japanese Patent Publication No. Hei 8-17391.

These examples are methods of composition analysis mainly with molecular ions as the target. There is also a demand for measuring only a specific elemental ion with a low-resolution mass spectrometer. As a particular example of this, is the city water supply potable water quality standards announced by the Ministry of Health and Welfare, and to judge these standards, an analyzing equipment is required that is capable of detecting the amount of metallic elements contained from a concentration level of several tens of parts per billion.

As an analyzing equipment for use in such fields, the mass spectrometer based on the inductive coupling plasma method (ICP-MS) has received attention because it has a high sensitivity although its mass number resolution is relatively low.

Even in such a field of analyzing elemental ions, since all the elements present in the specific mass number can be detected in a superimposed manner in a low resolution mass spectrometer, when measuring an unknown sample, it becomes necessary to eliminate unnecessary interference ions and extract only the target elemental ions.

As a method of eliminating such interference ions, conventionally, there was the method in which the user specifies the elements that are considered to be interference ions, such interference ions are measured along with the target elements, and from the results of such measurements, the amount of interference is calculated and removed.

In particular, regarding the elimination of interference due to molecular ions, as has been described in Japanese Patent Publication No. Hei 10-274640, a method has been disclosed regarding molecular ions, in which the correction amount is calculated using the ratio of isotope presence of specific elements. In this method, the procedure has been described of removing from the mass amount spectrum the mass peaks due to carbon isotopes using the presence ratio of the carbon mass numbers 12 and 13. However, there is no disclosure as to how to eliminate the interference due to elements other than carbon.

In the case of the method disclosed in Japanese Patent Publication No. Hei 10-274640, the user alone has to give considerations to the interference, and hence there were failures in measurement caused by insufficient considerations given by the user. In the field of analysis of small amounts of samples in which the measurements have to be made using limited samples, such mistakes in measurement can be fatal, and hence a method of eliminating the interference automatically, easily, and definitely was necessary.

SUMMARY OF THE INVENTION

When carrying out element analysis using a relatively low resolution mass spectrometer, it is common to measure the amount of ions detected in the isotope mass numbers of the target element, and to quantify the concentration value from that detected amount. However, since there are overlapping mass numbers among the isotopes of different elements, there are times when there other overlapping element isotopes or molecules at the target element isotope's mass number to be measured, and in such a case, the measurement result will contain interference from other elemental ions or molecular ions. In order to remove this interference, it was necessary that the user predict the element or the molecule whose mass number overlaps with that of the target, and in order to calculate the amount of that element or molecule, first measuring the isotope mass numbers of the interfering ions, and then calculating and eliminating the amount of interference for the target ion using the isotope presence ratio unique to that element.

In this method, if the user makes a mistake in considering the effect of interference or does not consider it at all, since the amount of interference will remain as such as a measurement error, a method was necessary for definitely and easily eliminate the amount of interference.

Further, in a mass spectrometer used for element analysis, since only the target mass numbers are scanned from the point of view of increasing the throughput, etc., the method of use of scanning a wide range of mass numbers only for the purpose of confirming the interference from other elements is not realistic, and a means was necessary for appropriately selecting the mass numbers necessary for eliminating interference.

The purpose of the present invention is to provide a mass spectrometry and a mass spectrometer using that method, which permit the measurement of the target ion amount easily and in a short time, even when other elemental ions cause interference to the target elemental ion at the time of measuring the amounts of isotope ions of a specific element.

In order to solve the above problems, the feature of the present invention is a mass spectrometry containing a step of setting the element to be measured as the first measurement target, a step of searching, using a previously registered element isotope information, for the element interfering with the first measurement target that has been set above, when an interfering element is found to be present from this search, a step of selecting the second measurement target from among the isotopes of that interfering element, a step of carrying out the measurements of said first measurement target and second measurement target, and a step of calculating the amount of ions of said first measurement target using the ion amount measurement result of said second measurement target.

Further, an additional feature of the present invention is that, in a mass spectrometer having an ion source that ionizes the sample, a mass analyzer section that carries out mass spectrometry of the sample ionized by the ion source, a detector section that detects the sample ions after mass spectrometry, and a data processing provided with a display section and an input section for carrying out the settings of different sections and display of the detected results, said data processing section has a storage section in which the information of element isotopes and isotope presence ratio is stored, and also said display section has an element selection area for specifying the element to be measured and an isotope information window for displaying the isotopes of the element selected in said element selection area, and the measurement target to be determined by selecting any isotope from the isotopes displayed in said isotope information window.

BRIEF DESCRIPTION OF THE DRAWINGS

FIG. 6 is an enlarged view of the element selection button 50 of FIG. 5.

FIG. 7 is an enlarged view of the isotope information window 51 of FIG. 5.

FIG. 8 is an enlarged view of the interference ion information window 52 of FIG. 5.

FIG. 12 is an enlarged view of the element selection button 61 of FIG. 11.

FIG. 13 is an enlarged view of the isotope information window 22 of FIG. 11.

FIG. 14 is an enlarged view of the measured ion information window 63.

FIG. 15 is an enlarged view of the interference ion information window 64 of FIG. 11.

FIG. 16 is an enlarged view of the interference molecular ion information window 64 of FIG. 11.

FIG. 17 is an example of the display of measurement results.

DETAILED DESCRIPTION OF THE PREFERRED EMBODIMENT

The example of installing the mass spectrometer according to the present invention in an inductive coupling plasma type mass spectrometer (ICP-MS) is described below with reference to the figures.

Figure 2:
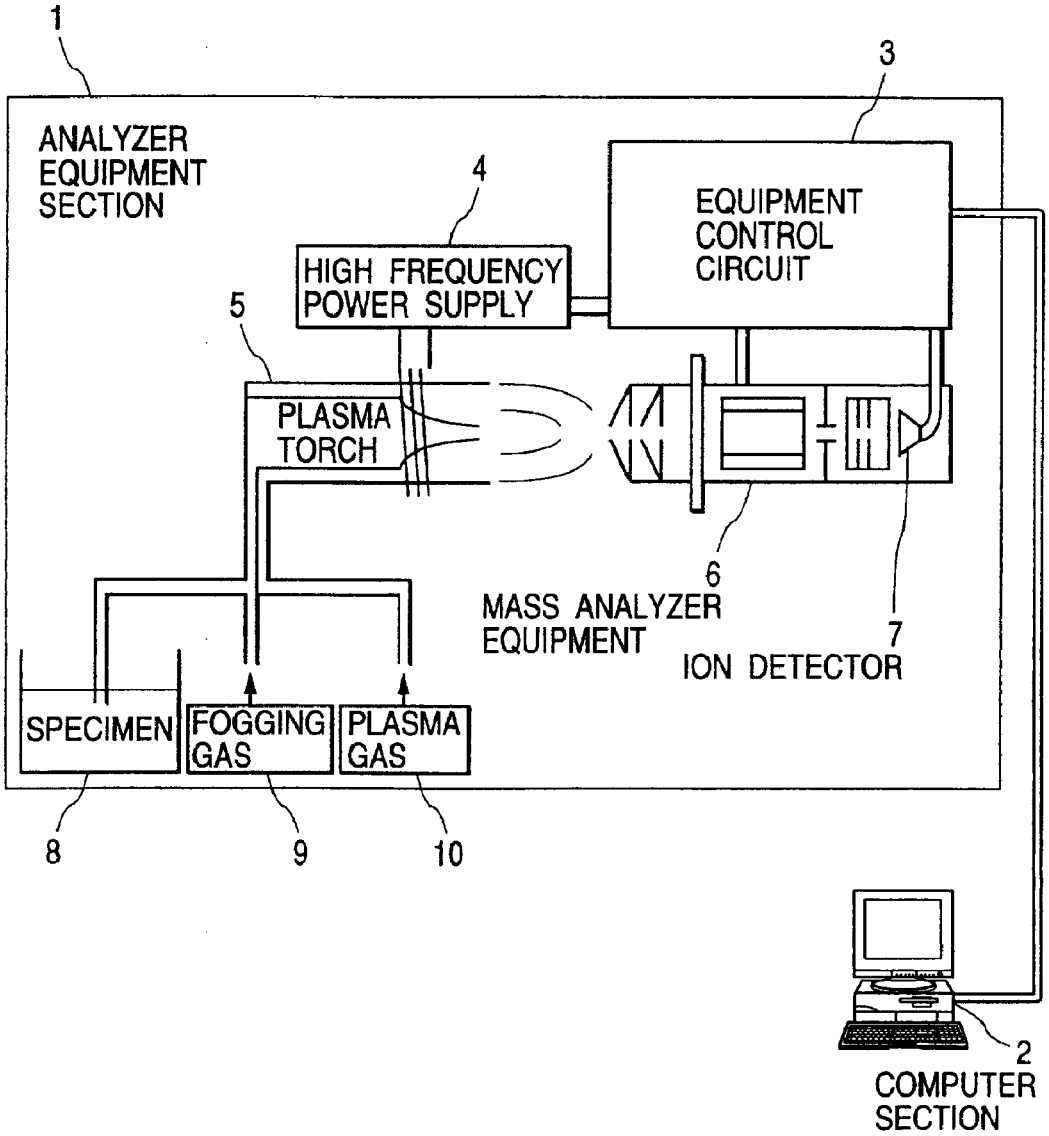
FIG. 2 is an outline configuration diagram of the equipment used in the present invention.

An outline configuration diagram of the present equipment is shown in FIG. 2. The present equipment mainly consists of the analyzer equipment section 1 and the computer section 2.

In the analyzer equipment section 1, the ionization of the sample is carried out by injecting the sample 8 in the form of a fine spray using the fogging gas 9 in the plasma generated by the plasma torch 5, the plasma gas 10, and the high frequency power supply 4. The ionized sample is screened for each mass number by the mass spectrometer 6, and is converted into an electrical signal by the ion detector 7. The high frequency power supply 4, the mass spectrometer 6, and the ion detector 7 are controlled by the equipment control circuit 3. The computer section 2 is provided with a display such as a CRT, memory unit for storing various types of information, a keyboard and pointing device for the input of information by the user, and is used for the setting of measurement conditions by the user and for displaying the result of measurement done using the ion detector 7.

Figure 5:
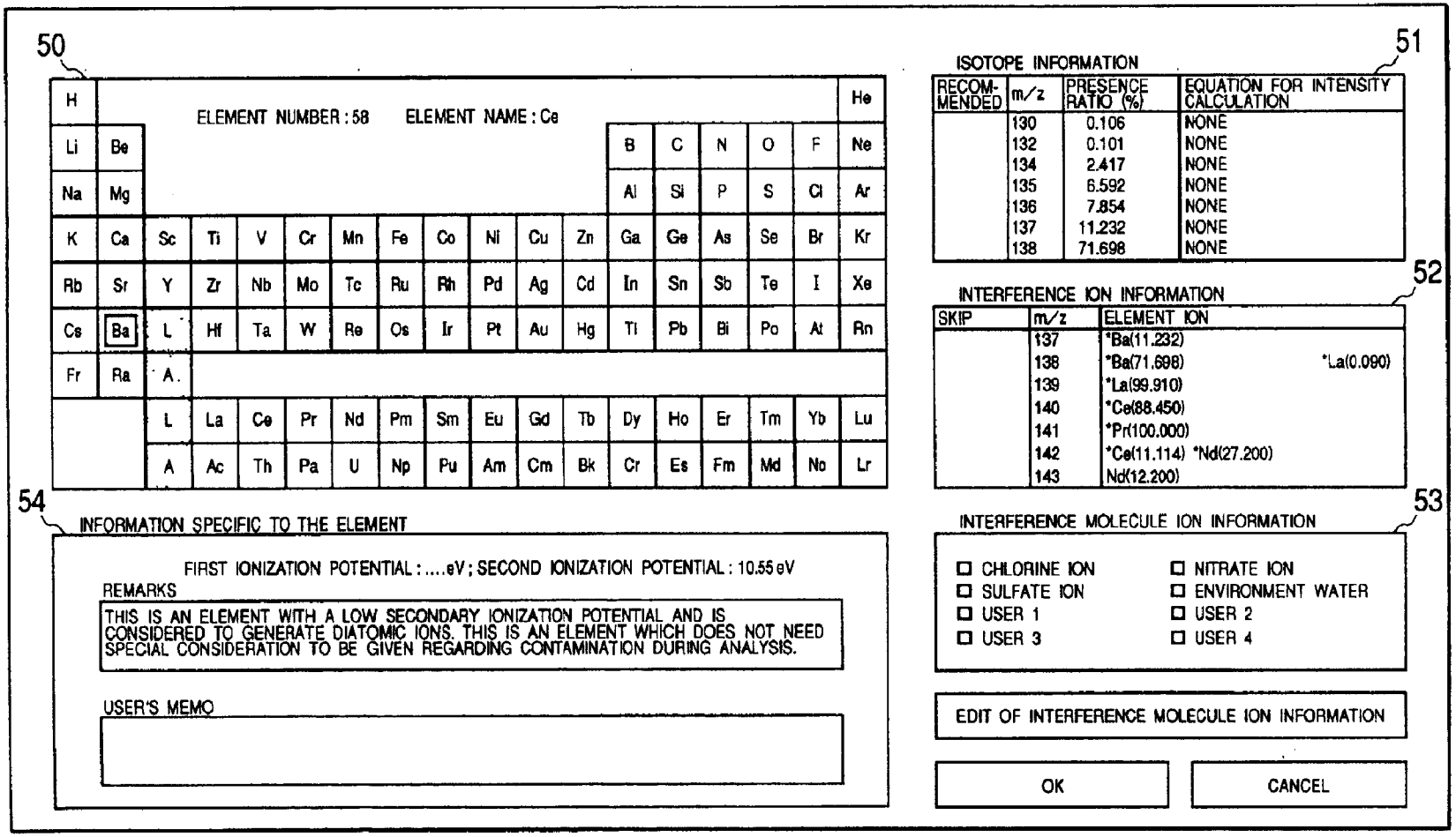
FIG. 5 is an example of the element and isotope information screen.

In the present invention, before carrying out the measurement, the screen shown in FIG. 5 is displayed on the display screen of the computer section 2, and the user can confirm the isotope or other information, and can select and set beforehand the specific elemental ion to be measured. The display screen of FIG. 5 is used for providing user support, and does not necessarily have to be displayed during measurement, and measurement is possible even without using the screen of FIG. 5.

Figure 9:
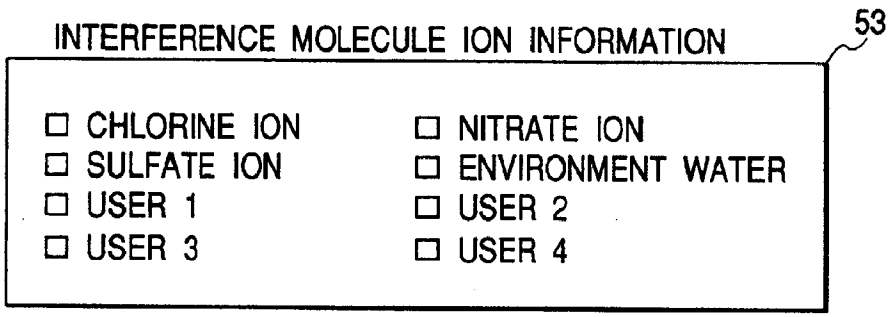
FIG. 9 is an enlarged view of the interference molecular ion information window 53 of FIG. 5.
Figure 10:
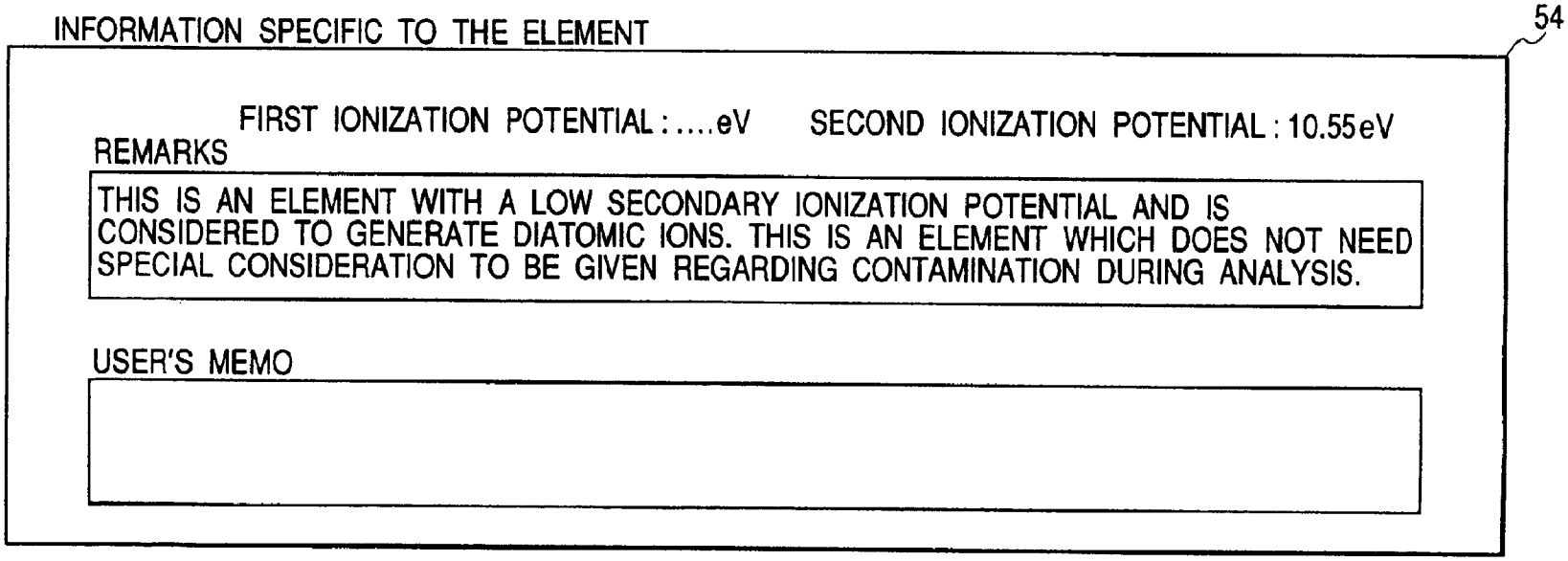
FIG. 10 is an enlarged view of the element specific information window 54 of FIG. 5.

The display screen of FIG. 5 is provided with different display windows of the element selection button 50, the isotope information window 51, the interference ion information window 52, the interference molecular ion information window 53, the element specific information window 54, etc. Further, the enlarged view of the element selection button 50 is shown in FIG. 6, the enlarged view of the isotope information window 51 is shown in FIG. 7, the enlarged view of the interference ion information window 52 is shown in FIG. 8, the enlarged view of the interference molecular ion information window 53 is shown in FIG. 9, and the enlarged view of the element specific information window 54 is shown in FIG. 10.

In the setting screen of FIG. 5, at the time of setting, by selecting the target element in the element selection button 50 (in concrete terms, the selection is done by moving the displayed cursor suing a pointing device such as a mouse, etc., to the desired element and then clicking the designated button), the isotope information window 51, the interference ion information window 52, and the element specific information window 54 for the selected element are all displayed instantaneously, thereby making it possible for the user to obtain all necessary information immediately. In the figures of these windows, the example shown is that of the display screens when the element Barium (Ba) with the element number of 56 has been selected.

Among these different display windows, the isotope information window 51 displays the information related to the isotopes of the element selected in the element section button 50. The computer section 2 has memorized the element and isotope information shown in FIG. 3, and the information displayed in the isotope information window 51 is based on the contents of FIG. 3. Further, in the isotope information window 51, the user select as the "Recommended isotope" the isotope to be measured as standard from among the elements having many isotopes. When the selection is made here, the setting will be made so that the recommended isotope is measured during the measurements. The selection is made, in concrete terms, by placing a check mark in the "Recommended" column for the required isotope. The example shown in FIG. 7 is the one when m/z=137, 138 are selected. Furthermore, in the isotope information window 51, it is possible to edit the "Equation for intensity calculation" which can define the method of eliminating the interference element, such as when wanting to eliminate the interference due to an element having an isotope with a specific identical mass number.

In the interference ion information window 52, the information is displayed of the isotopes of other elements that overlap with the mass number of the selected element. This information too is based on the element and isotope information of FIG. 3. In particular, if there are any mass numbers that have to be excluded from the target of measurement, say, for reasons such as it is difficult to correct for the interference, it is possible to skip the measurement of those specific items (that is, not to carry out their measurement) by selecting them as the ones to be skipped. In specific terms, this selection is made by placing a check mark in the "Skip" column for the required item.

In the interference molecular ion information window 53, it is possible to select whether or not even the information regarding interference ions has to be displayed in the interference ion information window 52. This interference molecular ion information has already been divided into those related to the four classes of chloride ions, nitrate ions, sulfate ions, and environment water ions, and has been registered as the standard information of the molecular ions that can cause interference, and the user can set up to a maximum of four any other types of interference molecular ions apart from the above. By selecting these items, it is possible to display the interference molecular ion information in the interference ion information window 52.

In the element specific information window 54, the precautions in analysis regarding the selected elements and memos that can be set by the user are displayed.

Next, the example of actually measuring a sample is described below.

Figure 11:
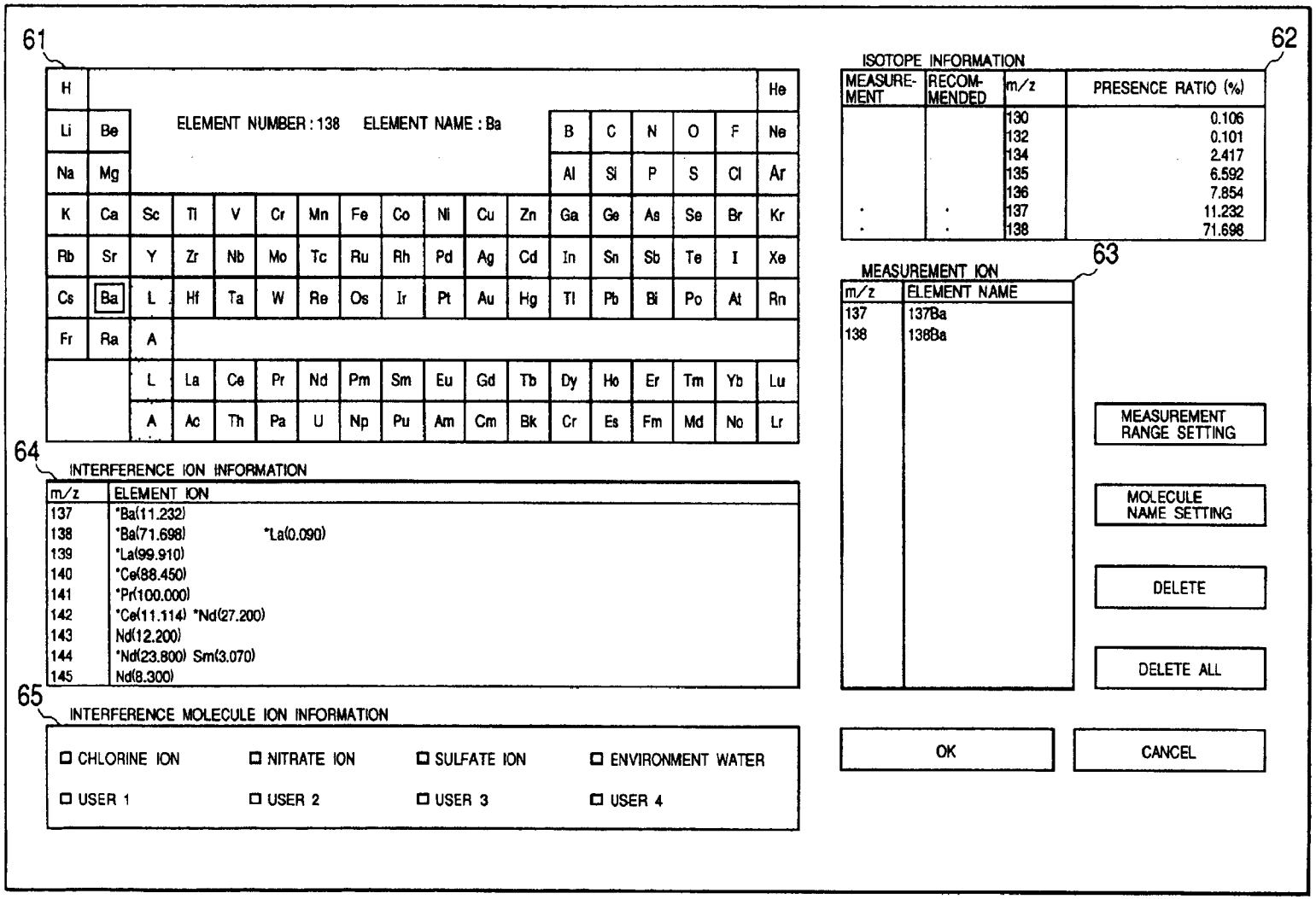
FIG. 11 is an example of the element selection screen during measurement.

To begin with, the user sets the sample in the analyzer equipment section 1, and gives the instruction about which elemental ion is to be measured in the computer section 2. An example of giving this instruction is shown in FIG. 11. The enlarged view of the element selection button 61 in FIG. 11 is shown in FIG. 12, the enlarged view of the isotope information window 62 is shown in FIG. 13, the enlarged view of the measured ion 63 is shown in FIG. 14, the enlarged view of the interference ion information window 64 is shown in FIG. 15, the enlarged view of the interference molecular ion information window 53 is shown in FIG. 16.

In the screen of FIG. 11, firstly, the element to be measured is selected in the element selection button 61. At this time, regarding the selected element, the information related to its isotopes is displayed in the isotope information window 62, the information regarding the other elemental isotopes and molecular isotopes that overlap the mass number of the selected element is displayed in the interference ion information window 64, with all the displayed being made instantaneously. All these information items are also based on the element and isotope information of FIG. 3.

Next, the isotopes to be measured among the isotopes of the selected element are selected in the isotope information window 62. In concrete terms, this selection is made by placing a check mark in the "Measurement" column of the window for the corresponding isotope. At this time, if the recommended isotopes have already been set in the screen of FIG. 5, the isotopes for which the "recommended" selection has already been made will automatically be selected as the "Measurement" isotopes when the corresponding element is selected in the element selection button 61. In FIG. 13, an example is shown in which the isotopes of m/z=137, 138 that have been set as the recommended isotopes in the screen of FIG. 5 (FIG. 7) have been selected as such as the measurement targets. As a consequence, if only the normally measured mass numbers are set as the targets for measurement, it is only sufficient to select the element in the element selection button 61 at the time of carrying out the measurements. Of course, when there are m/z values to be measured other than the ones registered as "Recommended", the user can manually select them in the screen of FIG. 13. On the other hand, the user can also deselect the ones that have been selected automatically. In that case, there is no effect of the setting of the recommended isotopes being changed permanently.

When this selection is made in the isotope information window 62, the selected isotope will be displayed in the measured ion 63. By repeating this selection for each element, the user can set the elemental ions that are to be taken as the measurement targets.

The interference molecular ion information window 65, similar to the interference molecular ion information window 53 in FIG. 9, is selected when wanting to display the information regarding the interference molecular ion information in the interference ion information window 64.

Although the setting of the conditions under which to make the measurements is also made at the same time as the above settings, the description of such settings has been omitted here for the sake of brevity.

When the instructions for measurement are given as described above in FIG. 11, in the computer section 2, a check is made of whether or not there are any other elements interfering with the measurement of the target elemental ion, and if any interfering ion is present, instructions are sent to the analyzer equipment section 1 to measure, along with the mass number of the measurement target elemental ion, the mass number necessary for calculating the amount of interfering elemental ions. The analyzer equipment section 1 measures the amount of ions with the specified mass number for the sample that has been set, and sends the ion amount measurement result to the computer. This measurement result is used to carry out the interference eliminating computation by the interference elimination computation section based on the interference ion information determined in the selection of interference ions. Here, only the amount of ions of the measurement target element is extracted and is indicated to the user as the intended measurement result of the ion amount.

Now, the above sequence of operations is explained below for the example of measuring the elemental ion 138Ba (denotes Barium with a mass number of 138, and this notation is also used hereafter) based on FIG. 1.

To begin with, in order to measure 138Ba, the user uses the setting screen of FIG. 11 to input (11) the instruction to measure 138Ba from the computer section 2. Because of this selection, the elements other than the user specified elements and that are present at the user's target mass number of 138 are searched (12) from the element and isotope information shown in FIG. 3. If the judgment (13) indicates that there is no interference to the target elemental ion, only the target mass number is measured (16) and the result is displayed (20).

Figures 3, 4:
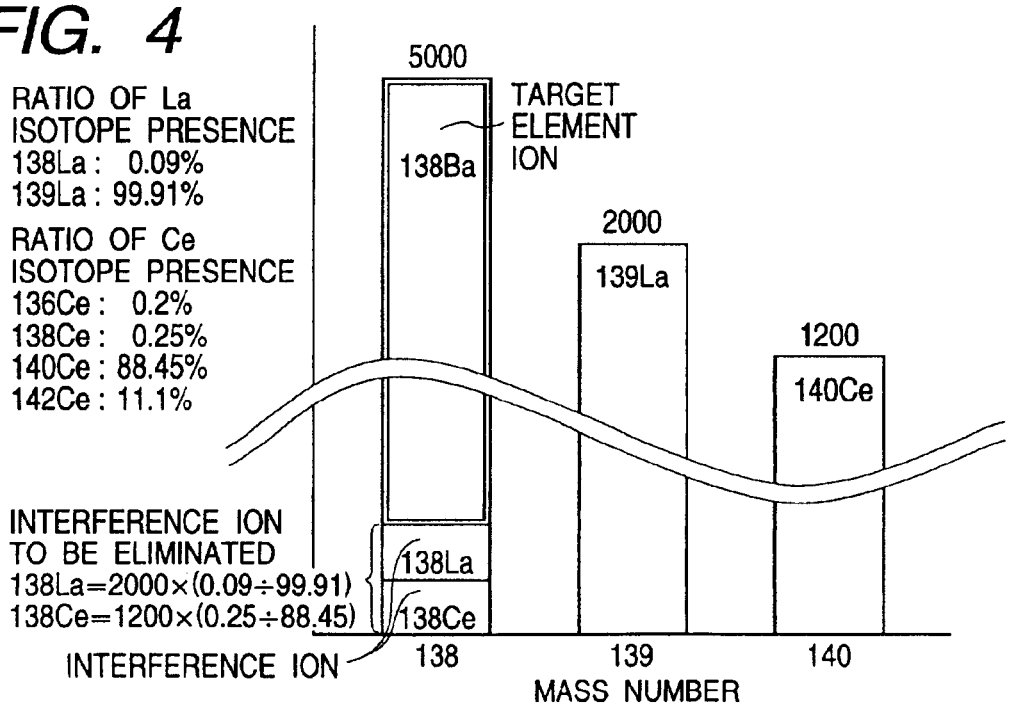
FIG. 3 is an example of the element and isotope information stored in the computer section.
FIG. 4 is a diagram showing the relationship with the amount of interference ion during the ion amount measurement of 138Ba.

In the case of the example of 138Ba, according to the element and isotope information of FIG. 3, it becomes clear that the elements 138La (Lanthanum) and 138Ce (Cerium) are present with the same mass number.

Since the isotope presence ratio of the elements is fixed and is already known, it is possible to calculate the interference elemental ion amount by measuring the isotope ions other than the mass number 138. In other words, when obtaining the value for 138La, the amount of the isotope 139La of 138La is measured, and by multiplying that value by the factor (0.089/99.911), it is possible to estimate the amount of presence of 138La. In other words, in order to obtain the amount of interference element ions, it is necessary to decide and measure at least one isotope of the interference element. This is done by extracting (14) the mass numbers of those isotopes, and selecting (15) the appropriate mass number from among them.

At this time, if, for example, La is not present in the sample, since the ions of 139La will not be detected, that is, since the measured ion amount has to be zero, the estimated ion amount of 138La will be zero even when calculated using this equation, it is possible to judge that there is no interference.

In a similar manner, it is possible to calculate the amount of interference ions of Ce. In the case of Ce, since there are many isotopes present, although one of those isotopes will have to be selected, if isotopes having interference from other elements are selected, it will become necessary to calculate also those interference elements, and hence the isotope selected in (15) should preferably be one that does not have interference from other elements. Therefore, considering this condition, 140Ce is selected.

As a result of carrying out the above operations, it is judged that the measurement of the mass numbers 139 and 140 is also necessary in addition to the measurement of the mass number 138, and the amount of ions of these mass numbers is measured (16). In the analyzer equipment section 1, the specified mass numbers of 138, 139, and 140 of the set sample are measured, and the result of measurement is returned to the computer section 2.

Thereafter, in the computer section 2, the presence ratios of the different elemental ions is extracted (17) based on the amounts of ions of different mass numbers received from the analyzer equipment section 1, and the amounts of interference ions is calculated (18). The method of such calculation is the following.

Amount of 138La ions=Amount of ions of mass number 139×(presence ratio of 138La÷presence ratio of 139La)

Amount of 138Ce ions=Amount of ions of mass number 140×(presence ratio of 138Ce÷presence ratio of 140Ca)

After the amount of interference ions is calculated, the calculation (19) of eliminating the interference ion amounts is done in order to calculate the amount of target elemental ions. The method of such calculation is the following.

Amount of 138Ba ions=Total amount of ions of mass number 138−amount of 138La ions−amount of 138Ce ions After this, the measured value of the amount of 138Ba ions with the interference eliminated is displayed as the calculated result (20).

Next, the example when the measured values obtained are 5000 counts for mass number 138, 2000 counts for mass number 139, and 1200 counts for mass number 140 is described below using FIG. 4. In this case, the calculations will be as follows $$138Ba = 5000 - 2000 \times (0.09 \div 99.91) - 1200 \times (0.25 \div 88.45) \quad (1)$$

$$= 5000 - 1.80 - 3.39$$

$$= 4994.81$$

Thus the amount of 138Ba ions is calculated as 4994.81 counts. Here, the value 1.80 in Eqn (1) is the amount of interference by La in the mass number 138, and the value 3.39 is the amount of interference by Ce in the mass number 138.

Further, an example of the display of the measurement results is shown in FIG. 17. In this display example, all the measured elemental ions other than 138Ba selected by the user have been displayed for the sake of explanation. A list of the measured elemental ions is displayed in the element column numbered 71. The peak mass number of the different measured elemental ions is shown in the peak m/z column numbered 72. The actual measured value of the signal intensity at that mass number is displayed in the intensity column numbered 73. This value is the one before carrying out elimination of the interference for the measurement target ion amount, and it can be seen that the values are 5000 counts for mass number 138, 2000 counts for mass number 139, and 1200 counts for mass number 140. The value indicated in the resolution column numbered 74 is an index of the degree of width of the mass number peak of the measured ions, and is not particularly concerned with the present invention. The corrected intensity column numbered 75 shows the result after carrying out elimination of the interference amount using the presence ratios of the isotopes of different elements. In this, the value for 138Ba is the desired result, and the value 4994.81 is being indicated as the value after eliminating interference. Further, the isotope presence ratios of different elements are shown in the reference ratios column numbered 76, the simple quantitative intensity value is shown in the intensity column 77, and the intensities of other elemental isotopes that are interfering are shown in the interference ion intensity column numbered 78, all as additional information.

Figure 1:
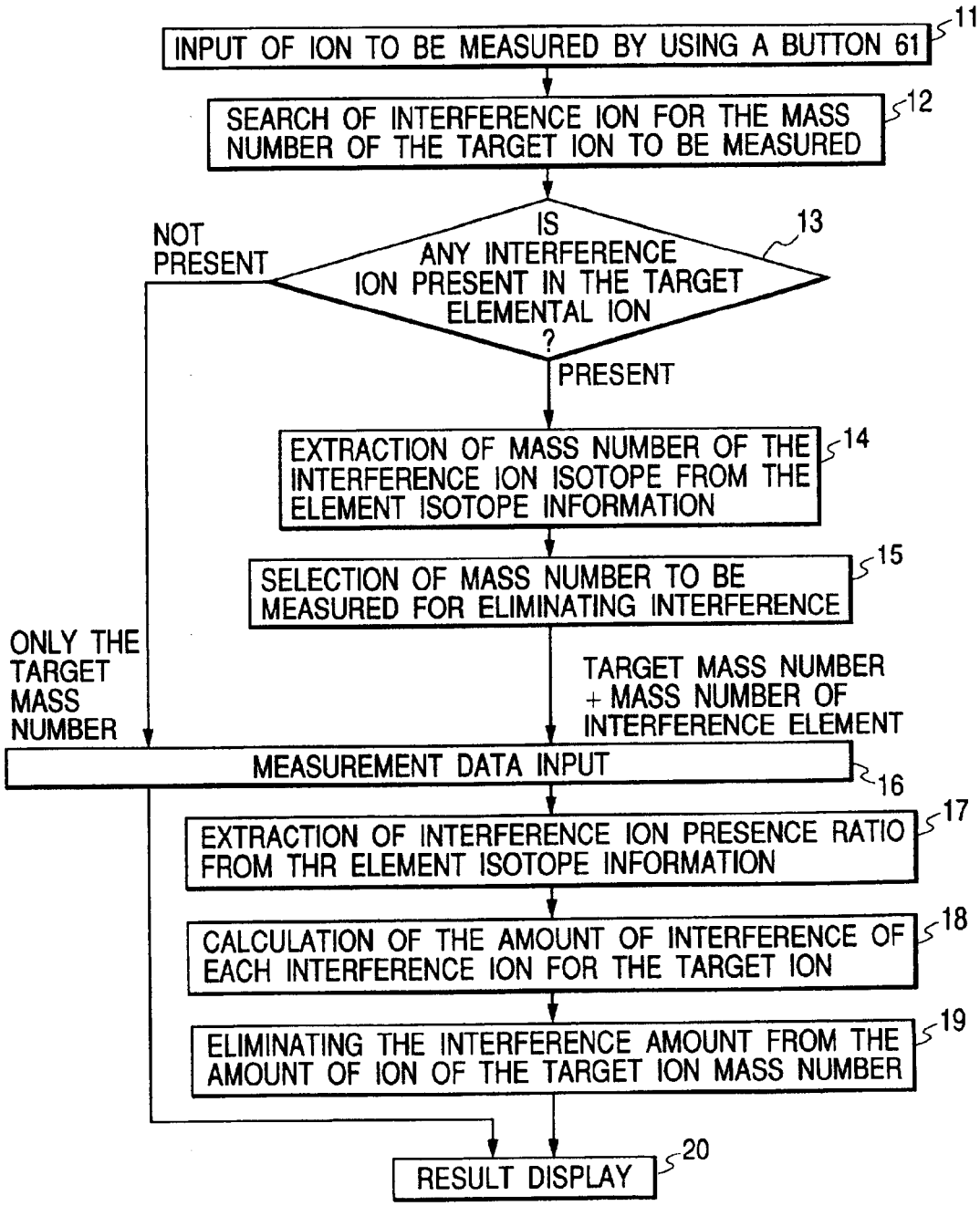
FIG. 1 is a diagram showing the processing flow of interference elimination processing according to the present invention.
Figure 18:
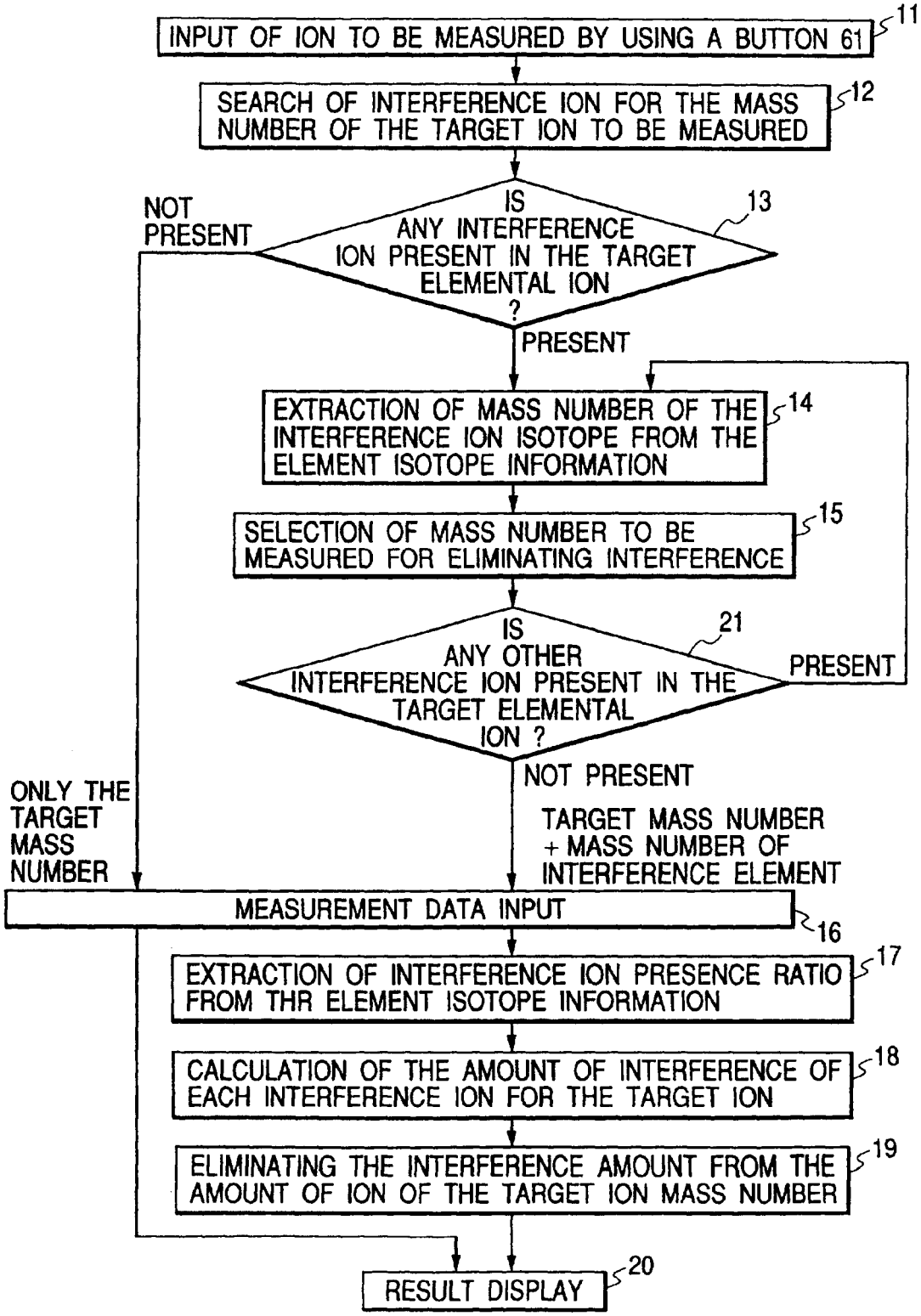
FIG. 18 is a diagram showing the processing flow of another interference elimination processing according to the present invention.

Next, an example of a processing flow other than the processing flow shown in FIG. 1 is described below referring to FIG. 18.

The feature of this processing flow is that, at the time of obtaining the amount of interference ions, the processing is done when there is another interference ion for the interference ion itself. As an example, the case of measuring 113Cd (Cadmium) is described below.

To begin with, to select 113Cd, the user inputs (11) in the computer to measure 113Cd. Because of this selection, the elements present in the user's target mass number of 113 other than 113Cd are searched (12) from the element and isotope information shown in FIG. 3. Next, using the result of this search, the judgment (13) is made of whether or not interference ions are present at the target mass number. If there are no interference ions present, the target mass number is measured (16) and the result is displayed (20).

In the case of 113Cd, it is clear that 113In (Indium) is present at the mass number 113. Therefore, the mass numbers of the isotopes of 113In, which is the interference element, are extracted (14), and the mass numbers to be measured for carrying out the interference elimination calculation are selected (15). Here, since only 115In is present as an isotope of 113In, although 115In is selected in the process (15), there is another interference element 115Sn (Tin) at the mass number of 115In. In such a situation, it is possible to measure the other isotope ions of 115Sn thereby calculating the interference amount of 115Sn, and then to calculate the amount of 115In by deducting the amount o 115Sn from the amount of ions at the mass number 115, and then to calculate the amount of 113Cd.

In this manner, when there is another interference ion for an interference ion, to deduct that interference, it is necessary to carry out the calculations recursively until the amount of interference ion can be established. To do this, it is necessary to judge (21) whether there is any interference for the mass number selected in step (15) for calculating the amount of interference ions, and if such additional interference is present, then, for that element, the steps (14) and (15) are carried out by selecting the mass number for calculating the interference amount, and this procedure is repeated until there is no interference.

In the case of this example, in addition to calculating the mass numbers 113 and 115 according to the above procedure, in order to calculate the amount of interference ions of Sn, the mass number 118 having no interference but with the highest presence ratio is measured.

In addition, at the time of calculating the result, first the amount of elemental ions with no interference is calculated, and then, the amounts of interference elemental ions are established successively. In this example, after measuring the mass numbers 113, 115, and 118, the calculation is done according to the following procedure.

Amount of 115Sn ions=Amount of ions of mass number 118×(presence ratio of 115Sn÷presence ratio of 118Sn)

Amount of 115In ions=Amount of ions of mass number 115−Amount of 115Sn ions

Amount of 113In ions=Amount of 115In ions×(presence ratio of 113In÷presence ratio of 115In)

Amount of 113Cd ions=Amount of ions of mass number 113−Amount of 113In ions

In this manner, by successively calculating the amounts of interference ions, it is possible to obtain the amount of the target 113Cd ions.

According to the present invention, even when element analysis is carried out using a relatively low-resolution quadruple-electrode type mass spectrometers, it is possible to obtain the measurement result desired by the user by automatically calculating the elimination of interference isotopes. In addition, by automating cumbersome calculations, it is possible to eliminate errors in calculation. Therefore, regarding the isotope identification by element analysis using a mass spectrometer, it is possible to provide to the users an easier to use system.

Furthermore, since it is possible to eliminate the interference by carrying out similar calculations even regarding the interference by molecular ions by expanding the element isotope information to include information of molecular ions, it is possible to carry out more advanced elimination of interference.

What is claimed is:

1. A method of mass spectrometry belonging to a method of mass spectrometry of ionizing a sample, analyzing its mass spectrum, and measuring the number of ions at each mass number, said method of mass spectrometry comprising:

setting an element to be measured as a first measurement target, said element having a first mass number, searching for isotopes of other elements that have said first mass number and interfere with said first measurement target using previously stored isotope information of elements;

when interfering isotopes of other elements are found to be present during said search, selecting a second measurement target from among other isotopes of the elements of said interfering isotopes having a mass number different than said first mass number, carrying out measurement of said first measurement target and said second measurement target, and calculating an amount of ions of said first measurement target using the measurement result of an amount of ions of said second measurement target.

2. A method of mass spectrometry as defined in claim 1, wherein said first measurement target is obtained by selecting from among element names displayed on a screen, isotopes of those selected elements being displayed on the screen, and selecting from among the displayed isotopes.

3. A method of mass spectrometry as defined in claim 1, wherein when there are several interference isotopes of elements for said first measurement target, several of said second measurement targets are selected.

4. A method of mass spectrometry as defined in claim 3, wherein the amount of interference ions interfering with said first measurement target is calculated from the amount of ions of said second measurement target, and the amount of ions of said first measurement target is calculated by subtracting an amount of ions of said interference isotopes of elements from an amount of ions measured at the mass number of said first measurement target.

5. A method of mass spectrometry for ionizing a sample, analyzing its mass spectrum, and measuring a number of ions at each mass number, said method of mass spectrometry comprising:

setting an element to be measured as the first measurement target, said element having a first mass number;

searching for isotopes of other elements that have said first mass number and interfere with said first measurement target using previously stored isotope information of elements;

when interfering isotopes of other elements are found to be present during said search, searching for another isotope of the other element with no other interfering element present from among other isotopes of the elements of said interfering isotopes having a mass number different than said first mass number, and selecting it as a second measurement target;

carrying out measurement of said first measurement target and said second measurement target, and;

calculating an amount of ions of said first measurement target using the measurement result of an amount of ions of said second measurement target.

6. A method of mass spectrometry as defined in claim 5 wherein said first measurement target is obtained by selecting from among element names displayed on a screen, isotopes of those selected elements being displayed on the screen, and selecting from among the displayed isotopes.

7. A method of mass spectrometry as defined in claim 5, wherein when there are several interference elements for said first measurement target, several of said second measurement targets are selected.

8. A method of mass spectrometry as defined in claim 7 said method of mass spectrometry, wherein an amount of interference ions interfering with said first measurement target is calculated from an amount of ions of said second measurement target, and an amount of ions of said first measurement target is calculated by subtracting an amount of ions of said interference elements from an amount of ions measured at the mass number of said first measurement target.

9. A mass spectrometer having an ion source that ionizes the sample, a mass analyzer section that analyzes the mass of the sample that is ionized by the ion source, a detection section that detects sample ions subjected to mass analysis, and a data processing section containing a display section and an input section for carrying out settings of different sections and display of detection results, said mass spectrometer comprising:

said data processing section having a storage section in which the information of isotopes of elements and of isotope presence ratios has been stored, said display section is provided with an element selection area for specifying an element to be measured and an isotope information area for displaying isotopes of the element selected in said element selection area, and a measurement target is determined by selecting any isotope from those displayed in said isotope information area, wherein said display section is provided with an interference ion information area for displaying the interference ion information of the isotopes selected in said isotope information area.

10. A mass spectrometer as defined in claim 9, wherein the information displayed in said isotope information area and in said interference ion information area are displayed based on information stored in said storage section.

* * * * *